US010802413B1

(12) United States Patent
Araki et al.

(10) Patent No.: US 10,802,413 B1
(45) Date of Patent: Oct. 13, 2020

(54) CHARGING DEVICE, IMAGE FORMING STRUCTURE, AND IMAGE FORMING DEVICE

(71) Applicant: FUJI XEROX CO., LTD., Tokyo (JP)

(72) Inventors: Keishi Araki, Kanagawa (JP); Hiroki Ando, Kanagawa (JP); Hirofumi Iida, Kanagawa (JP); Satoshi Mizoguchi, Kanagawa (JP); Hiroki Oka, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 16/560,279

(22) Filed: Sep. 4, 2019

(30) Foreign Application Priority Data

Mar. 20, 2019 (JP) ..... 2019-052657

(51) Int. Cl.
*G03G 15/02* (2006.01)
*G03G 15/16* (2006.01)

(52) U.S. Cl.
CPC ..... *G03G 15/0258* (2013.01); *G03G 15/0216* (2013.01); *G03G 15/1655* (2013.01)

(58) Field of Classification Search
CPC ..... G03G 15/0216; G03G 15/0225; G03G 15/0233; G03G 15/0258; G03G 15/0266; G03G 2215/025; G03G 2221/1693
See application file for complete search history.

(56) References Cited

U.S. PATENT DOCUMENTS

2008/0025753 A1* 1/2008 Yamamoto ..... G03G 15/0225 399/100
2012/0082475 A1 4/2012 Kawai

FOREIGN PATENT DOCUMENTS

JP 2012-078518 A 4/2012

* cited by examiner

*Primary Examiner* — Thomas S Giampaolo, II
(74) *Attorney, Agent, or Firm* — Sughrue Mion, PLLC

(57) ABSTRACT

A charging device includes: a charging member that is rotatable and has a peripheral surface to be in contact with a charging target and to which a voltage is to be applied for charging the charging target; a removing member that includes a core and a removing material spirally wound one to less than two times around the core and rotates and comes into contact with the charging member to remove an unnecessary material from the peripheral surface of the charging member; and a detecting unit that detects a current flowing between the charging member and the removing member.

7 Claims, 3 Drawing Sheets

CHARGING DEVICE, IMAGE FORMING STRUCTURE, AND IMAGE FORMING DEVICE

CROSS-REFERENCE TO RELATED APPLICATIONS

This application is based on and claims priority under 35 USC 119 from Japanese Patent Application No. 2019-052657 filed Mar. 20, 2019.

BACKGROUND

(i) Technical Field

The present disclosure relates to a charging device, an image forming structure, and an image forming device.

(ii) Related Art

In the related art, there is known a charging device including a cleaning roller that rotates in contact with a charging roller.

For example, JP-A-2012-78518 discloses a charging device including a cleaning roller having an elastic layer spirally disposed around an outer peripheral surface of a core.

However, if the level of staining varies in a direction along the shaft of the charging roller, the resistance value of the charging roller would vary to cause a charging difference. In addition, if the resistance value varies as the charging roller deteriorates over time, a charging difference would also occur.

SUMMARY

Aspects of non-limiting embodiments of the present disclosure elate to detecting a resistance value difference in a direction along the shaft of a charging member.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a charging device including: a charging member that is rotatable and has a peripheral surface to be in contact with a charging target and to which a voltage is to be applied for charging the charging target; a removing member that includes a core and a removing material spirally wound one to less than two times around the core and rotates and comes into contact with the charging member to remove an unnecessary material from the peripheral surface of the charging member; and a detecting unit that detects a current flowing between the charging member and the removing member.

BRIEF DESCRIPTION OF THE DRAWINGS

Exemplary embodiments of the present invention will be described in detail based on the following figures, wherein.

DETAILED DESCRIPTION

Exemplary embodiments of the present disclosure will be described below with reference to the drawings. The drawings referred to below are schematic diagrams, and sizes and the like cannot be regarded as accurate.

Figure 1:
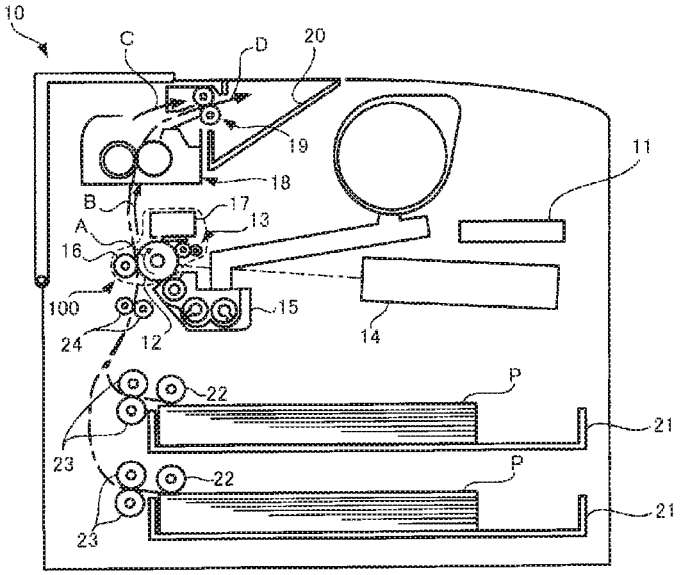
FIG. 1 is a schematic configuration view of a printer corresponding to an exemplary embodiment of an image forming device of the present disclosure.

FIG. 1 is a schematic configuration view of a printer corresponding to an exemplary embodiment of an image forming device of the present disclosure.

A printer 10 shown in FIG. 1 is a monochrome printer, and an exemplary embodiment of a charger of the present disclosure is incorporated in the printer 10.

An image signal representing an image created outside the printer 10 is input to the printer 10 via a signal cable (not shown) or the like. The printer 10 is provided with a controller 11 that controls a movement of each configuration component in the printer 10, and the image signal is input to the controller 11. Further, an image is formed in the printer 10 based on the image signal under the control of the controller 11.

For example, two sheet trays 21 are accommodated in a lower part of the printer 10. In the sheet trays 21, sheets P with different sizes are accommodated in a stacked state in each of the sheet trays 21. Each of the sheet trays 21 is drawable in order to supply the sheets P thereto.

Among the two sheet trays 21, the sheets P having a size suitable for a size of the image represented by the image signal input to the controller 11 are fed from the sheet tray by a pickup roller 22. The fed sheets P are separated one by one by retard rollers 23, the separated one of the sheets P is transported upward, and a leading end of the sheet P reaches standby rollers 24. The standby rollers 24 play a role of adjusting timing of subsequent transport thereof to feed the sheet P. The sheet P that has reached the standby rollers 24 is further transported by adjusting the timing of the subsequent transport thereof by the standby rollers 24.

In the printer 10, a photoconductor 12 rotating in a direction indicated by an arrow A is provided above the standby rollers 24. Further, a charger 13, an exposure unit 14, a developing unit 15, a transfer unit 16, and a photoconductor cleaner 17 are arranged around the photoconductor 12.

The photoconductor 12 has a cylindrical shape, extends in a depth direction of FIG. 1, holds an electric charge generated by the charger 13 on a surface, and emits the electric charge by exposure by the exposure unit 14 to form an electrostatic latent image on the surface. The photoconductor 12 corresponds to an example of an image carrier according to the present disclosure.

The charger 13 applies the electric charge to the surface of the photoconductor 12 via a member that rotates in contact with the surface of the photoconductor 12. The charger 13 corresponds to an exemplary embodiment of the charger of the present disclosure. Details of the charger 13 will be described later.

The exposure unit 14 includes a light emitter that emits laser light (that is, exposure light) modulated in accordance with the image signal supplied from the controller 11, and a rotary polygon mirror for scanning the photoconductor 12 by laser light, and the exposure light is output from the exposure unit 14. The photoconductor 12 is exposed to the exposure light, and the electrostatic latent image is formed on the surface of the photoconductor 12. The exposure unit 14 corresponds to an example of a latent image forming unit according to the present disclosure.

The electrostatic latent image formed on the surface of the photoconductor 12 is developed by the developing unit 15. As a result of development by the developing unit 15, a toner image is formed on the surface of the photoconductor 12. The developing unit 15 corresponds to an example of a developing unit according to the present disclosure, and a combination of the exposure unit 14 and the developing unit 15 corresponds to an example of an image forming unit according to the present disclosure.

Here, the standby rollers 24 feed the sheet P such that the sheet P reaches a position facing the transfer unit 16 in accordance with timing at which the toner image on the photoconductor 12 reaches the position. Then, the toner image on the photoconductor 12 receives an action of the transfer unit 16 and is transferred onto the sheet P that has been fed. The toner remaining on the photoconductor 12 after the transfer of the toner image is removed from the photoconductor 12 by the photoconductor cleaner 17.

In the present exemplary embodiment, an assembly of the photoconductor 12, the charger 13, the transfer unit 16, and the photoconductor cleaner 17 is assembled as a so-called process cartridge 100 and is integrally detachable from the printer 10. The process cartridge 100 corresponds to an exemplary embodiment of the image forming structure of the present disclosure.

The sheet P subjected to the transfer of the toner image is further advanced in a direction of an arrow B, and the toner image is fixed on the sheet P by heating and pressing by a fixing device 18. As a result, an image formed of a fixed toner image is formed on the sheet P.

The sheet P that passed through the fixing device 18 advances in a direction of an arrow C toward the discharge device 19, and is further fed in a direction of an arrow D by the discharge device 19 and discharged onto a sheet discharge tray 20.

Hereinafter, the charger 13 will be described in detail.

Figure 2:
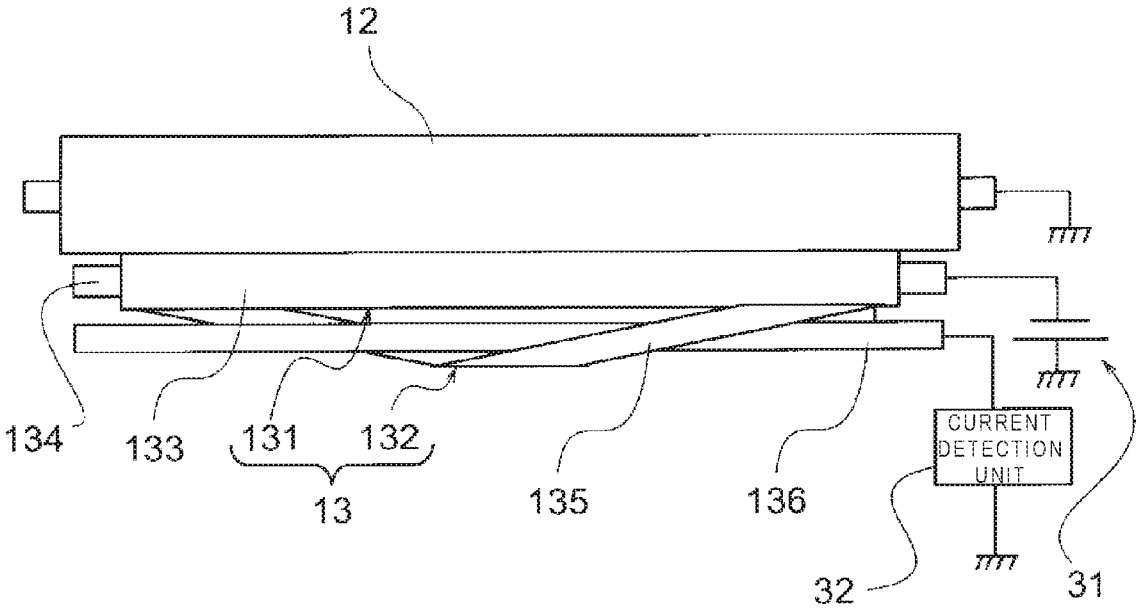
FIG. 2 is a diagram schematically showing a photoconductor and a charger.

FIG. 2 is a diagram schematically showing the photoconductor and the charger.

A left-right direction in FIG. 2 corresponds to the depth direction in FIG. 1.

The charger 13 includes a charging roller 131 that rotates in contact with the surface of the photoconductor 12, and a cleaning roller 132 that rotates in contact with a surface of the charging roller 131. The charging roller 131 rotates by receiving a force for rotating the photoconductor 12, and the cleaning roller 132 rotates by receiving a force for rotating the charging roller 131. A diameter of the charging roller 131 is smaller than a diameter of the photoconductor 12, and the charging roller 131 rotates plural times while the photoconductor 12 rotates once. In addition, a diameter of the cleaning roller 132 is smaller than the diameter of the charging roller 131, and the cleaning roller 132 rotates plural times while the charging roller 131 rotates once.

Similarly to the photoconductor 12, the charging roller 131 and the cleaning roller 132 extend in the left-right direction in FIG. 2. The charging roller 131 charges the surface of the photoconductor 12 by applying the electric charge to the surface thereof. The cleaning roller 132 removes unnecessary materials such as discharge products and sheet dust from the surface of the charging roller 131. The charging roller 131 corresponds to an example of the charging member of the present disclosure, and the cleaning roller 132 corresponds to an example of a removing member of the present disclosure.

As an example, the charging roller 131 has a structure in which a conductive rubber layer 133 is provided around a rotation shaft 134 made of metal. The cleaning roller 132 has a structure in which, for example, a cleaning member 135 having a foamed structure is spirally wound around a rotation shaft 136 made of metal. The cleaning member 135 is wound one to less than two times around the rotation shall 136. The rotation shaft 136 corresponds to an example of the core according to the present disclosure, and the cleaning member 135 corresponds to an example of the removing material according to the present disclosure.

The charging roller 131 of the charger 13 is connected to a DC power supply 31, and a voltage is applied to the charging roller 131 by the DC power supply 31. The charger 13 charges the surface of the photoconductor 12 by the voltage applied to the charging roller 131. On the other hand, the current flows from the charging roller 131 to the cleaning roller 132 by the voltage applied to the charging roller 131. The charger 13 is provided with a current detection unit 32 that detects the current flowing through the cleaning roller 132.

Figure 3:
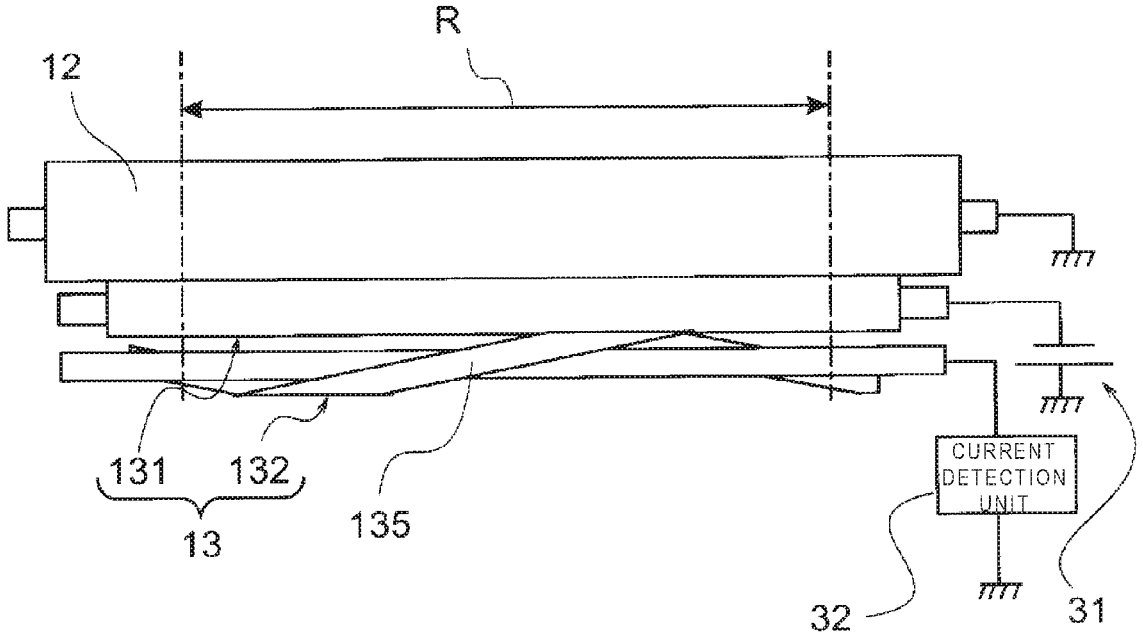
FIG. 3 is a view showing a state in which a cleaning roller is rotated from a state shown in FIG. 2.

FIG. 3 is a view showing a state in which the cleaning roller is rotated from the state shown in FIG. 2.

As described above, the cleaning member 135 is wound one to less than two times around the rotation shaft 136. Therefore, the contact between the cleaning roller 132 and the charging roller 131 is at one place of the spiral of the cleaning member 135 at a center part of the charging roller 131, and at two places of both ends of the cleaning member 135 at end portions of the charging roller 131 (see FIG. 2).

On the photoconductor 12, the electrostatic latent image and the toner image are formed in an image forming region R corresponding to a maximum size of the sheet. Further, in the image forming region R in a peripheral surface of the charging roller 131, the cleaning roller 132 is in contact with the charging roller 131 at only one place of the cleaning member 135.

Figure 4:
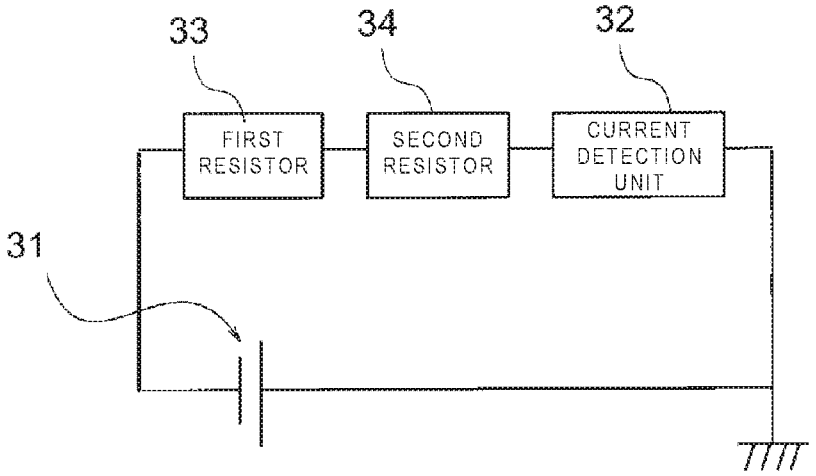
FIG. 4 is an equivalent circuit diagram showing a flow channel of current detected by a current detection unit.

FIG. 4 is an equivalent circuit diagram showing a flow channel of the current detected by the current detection unit.

The current flowing from the power supply 31 to the current detection unit 32 passes through a first resistor 33 corresponding to the charging roller 131 and a second resistor 34 corresponding to the cleaning roller 132. When the current is detected by the current detection unit 32, the resistance value of the first resistor 33 (that is, the resistance value of the charging roller 131) is detected. Since the resistance value of the charging roller 131 changes due to deterioration over time or staining of the surface, the resistance value of the charging roller 131 is detected by the current detection unit 32, so that deterioration or staining of the charging roller 131 is detected.

Figure 5:
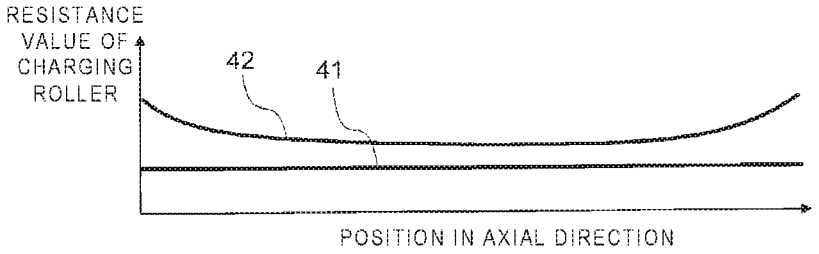
FIG. 5 is a graph showing an example of a resistance value of the charging roller.

FIG. 5 is a graph showing an example of the resistance value of the charging roller.

A horizontal axis of the graph of FIG. 5 indicates the position in the direction along the rotation shaft 133 of the charging roller 131, and a vertical axis indicates the resistance value of the charging roller.

A resistance value 41 in a case where the charging roller 131 is new indicates a uniform value at various points in the direction along the rotation shaft 133 of the charging roller 131, and also indicates a low value. On the other hand, a resistance value 42 in a case where the charging roller 131 changes over time due to staining or deterioration indicates a value higher than the resistance value 41 in the case where the charging roller 131 is new. Generally, the resistance value 42 in the case where the charging roller 131 changes over time is non-uniform in the direction along the rotation shaft 133, and has a higher value at both ends than at the center part.

When the resistance value of the charging roller 131 increases, the ability to charge the photoconductor 12 decreases. If the resistance value of the charging roller 131 is non-uniform, a charging ability may become non-uniform, and non-uniformity in a density of the toner image may be generated.

Thus, the resistance value of the cleaning roller 132 is substantially constant over time and in positions with respect to the charging roller 131 indicating the change in the resistance value.

The current is detected by the current detection unit 32 while the charging roller 131 and the cleaning roller 132 are rotating.

Figure 6:
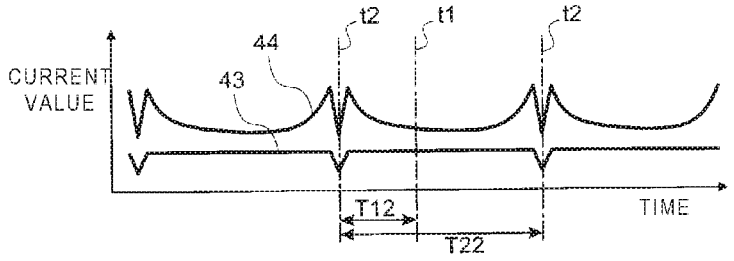
FIG. 6 is a graph showing an example of a current value detected by the current detection unit.

FIG. 6 is a graph showing an example of a current value detected by the current detection unit.

A horizontal axis of the graph of FIG. 6 indicates time, and a vertical axis indicates the current value. However, for convenience of comparison with the resistance value, the upper side of the figure is the side where the current value is small.

A temporal change occurs repeatedly in current values 43, 44 for each rotation of the cleaning roller 132. Further, at timing t2 at which the cleaning roller 132 is brought into contact with the charging roller 131 at two places in the cleaning member 135, since the second resistor 34 shown in FIG. 4 temporarily decreases, peaks are generated in current values 43, 44. At time t1 between the current peaks, the cleaning roller 132 is brought into contact with the charging roller 131 at one place of the cleaning member 135, and the contact place moves from one end to the other end of the charging roller 131 over time. That is, detection positions of the current values 43, 44 are moved from one end to the other end of the charging roller 131, and the current values 43, 44 at each position along the rotation shaft 133 of the charging roller 131 are detected.

Therefore, during the timing t2 of the current peak, the graph shapes of the current values 43, 44 correspond to the graph shapes of the resistance values 41, 42 shown in FIG. 5. That is, the graph of the current value 43 shown a lower part of FIG. 6 is the current value 43 when the charging roller 131 is new, and the graph of the current value 44 shown in an upper part in FIG. 6 is the current value 44 when the charging roller 131 changes over time. The resistance value at each position along the rotation shaft 133 of the charging roller 131 is calculated from such current values 43, 44. Alternatively, the current value itself may also be used as an index of the resistance value. Further, a difference in the resistance value in the direction along the rotation shaft 133 is also obtained by obtaining the resistance value at each position along the rotation shaft 133.

From the ratio of an elapsed time T12 from the timing t2 of the current peak to the time t1 between the current peaks to a time interval T22 between current peak tunings t2, a contact position in the case where the cleaning roller 132 is brought into contact with the charging roller 131 at one place is calculated based on contact positions in the case where the cleaning roller 132 is brought into contact with the charging roller 131 at two places. The contact position calculated in this way corresponds to the position at which the current value and the resistance value are detected.

The controller 11 shown in FIG. 1 has a function of calculating the detection position as described above, and also has a control function of using the detected current value.

Figure 7:
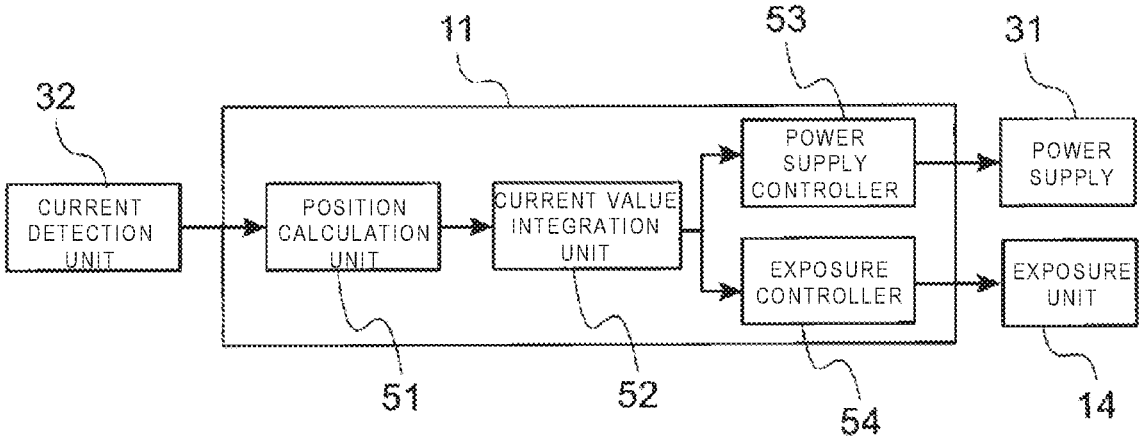
FIG. 7 is a functional block diagram showing a function of a controller.

FIG. 7 is a functional block diagram showing a function of the controller.

The controller 11 includes a position calculation unit 51, a current value integration unit 52, a power supply controller 53, and an exposure controller 54 as functions.

The position calculation unit 51 acquires the current value detected by the current detection unit 32, and calculates the position where the current value is detected, based on the timing t2 of the peak of the current value as described above.

The current value integration unit 52 adds up the current values detected by the current detection unit 32 for each detection position. Since the cleaning roller 132 rotates plural times per one rotation of the charging roller 131, the current value integration unit 52 preferably performs integration over one rotation of the charging roller 131. By such integration, the resistance value of the charging roller 131 can be obtained with high accuracy.

The power supply controller 53 determines the staining of the charging roller 131 by comparing the resistance value of the charging roller 131 with the resistance value when the charging roller 131 is new. For example, it is determined that the charging roller 131 is stained when an average value of the resistance value over the entire length of the charging roller 131 increases to some extent as compared with the resistance value when the charging roller 131 is new. Further, when the charging roller 131 is stained, the power supply controller 53 increases the voltage of the power supply 31. When the voltage is increased in this way, cleaning ability of the cleaning roller 132 is increased, and the staining of the charging roller 131 is reduced. When the staining of the charging roller 131 is reduced and the resistance value decreases, the power supply controller 53 returns the voltage of the power supply 31 to an original voltage. The power supply controller 53 corresponds to an example of a controller according to the present disclosure.

The exposure controller 54 obtains uniformity of the resistance value of the charging roller 131, for example, by obtaining a difference between resistance values detected at the end and center portions of the charging roller 131. Further, when the uniformity is lowered to some extent to generate non-uniformity in a density of the image, an exposure amount in the exposure unit 14 is adjusted to increase the exposure amount at a place where the resistance value of the charging roller 131 is high. As a result, the electrostatic latent image becomes uniform, and the density of the toner image also becomes uniform. The exposure controller 54 corresponds to an example of an adjustment unit according to the present disclosure.

As a result of the control by the power supply controller 53 and the exposure controller 54, in the printer 10 shown in FIG. 1, even when the resistance value of the charging roller 131 changes over time due to staining or deterioration, the image density is stabilized.

Although non-uniformity generated by deterioration over time is shown as an example in which the resistance value of the charging roller 131 is non-uniform in the direction along the rotation shaft in the above description, the non-uniformity in a state where the charging roller is not used may be detected at a time of manufacturing the charger or at a time of shipment or installation of the image forming device. When the non-uniformity is detected in the unused state as described above, in order to make the toner density uniform, the situation may be fed back to the control of charging, exposure, development, transfer or the like at the time of forming the toner image.

In addition, in the above description, although the monochrome printer is shown as an example of the image forming device of the present disclosure, the image forming device of the present disclosure may also be a color printer, a copier, a facsimile, or a multifunction device.

In addition, in the above description, although an exposure unit is exemplified as the latent image forming unit according to the present disclosure, the latent image forming unit according to the present disclosure may also form a latent image by, for example, an electrode.

In addition, in the above description, although a roll-shaped photoconductor is exemplified as an image carrier according to the present disclosure, the image carrier according to the present disclosure may also be a belt-shaped member.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A charging device comprising:

a charging member that is rotatable, wherein the charging member has a peripheral surface configured to be in contact with a charging target, and wherein the charging member is configured such that a voltage may be applied to the charging member for charging the charging target;

a removing member that includes a core and a removing material spirally wound one to less than two times around the core, wherein the removing member is configured to rotate and to come into contact with the charging member to remove an unnecessary material from the peripheral surface of the charging member;

a detecting unit configured to detect a current flowing between the charging member and the removing member; and a control unit configured to cause the removing member to execute removal of the unnecessary material if the detecting unit detects by current detection that the charging member is stained, wherein the control unit is configured to, in response to the detecting unit detecting that the charging member is stained, increase the voltage applied to the charging member when the removing member removes the unnecessary material.

2. An image forming structure comprising:

an image carrier configured to hold an image formed on a surface;

a charging member that is rotatable, wherein the charging member has a peripheral surface configured to be in contact with the image carrier, and wherein the charging member is configured such that a voltage may be applied to the charging member for charging the image carrier; and a removing member that includes a core and a removing material spirally wound one to less than two times around the core, wherein the removing member is configured to rotate and to come into contact with the charging member to remove an unnecessary material from the peripheral surface of the charging member, wherein the image forming structure further comprises:

a detecting unit configured to detect a current flowing between the charging member and the removing member; and a control unit configured to cause the removing member to execute removal of the unnecessary material if the detecting unit detects by current detection that the charging member is stained, wherein the control unit is configured to, in response to the detecting unit detecting that the charging member is stained, increase the voltage applied to the charging member when the removing member removes the unnecessary material.

3. An image forming device comprising:

an image carrier configured to hold an image formed on a surface;

a charging member that is rotatable, wherein the charging member has a peripheral surface configured to be in contact with the image carrier, and wherein the charging member is configured such that a voltage is may be applied to the charging member for charging the image carrier;

an image forming unit configured to form the image on the image carrier charged by the charging member; and a removing member that includes a core and a removing material spirally wound one to less than two times around the core, wherein the removing member is configured to rotate and to come into contact with the charging member to remove an unnecessary material from the peripheral surface of the charging member, wherein the removing member is configured to be brought into contact with the peripheral surface of the charging member at at most one place of the spiral of the removing material within an image forming area in a direction in which the charging member extends, and wherein the image forming device further comprises an adjustment unit configured to perform density adjustment in image formation by the image forming unit if current detection by a detecting unit indicates a charge difference in a direction in which the charging member extends, so that an image density difference is prevented, which would otherwise be associated with the charge difference.

4. The image forming device according to claim 3, wherein the image forming unit includes:

a latent image forming unit configured to form an electrostatic latent image on the image carrier; and a developing unit configured to develop the latent image, and wherein the adjustment unit is configured to adjust latent image formation performed by the latent image forming unit.

5. The image forming device according to claim 3, further comprising:

a contact position calculation unit configured to calculate a contact position on the charging member in a case where one place of the removing member is brought into contact with the peripheral surface of the charging member, wherein the contact position calculation unit is configured to calculate the contact position using plural contact positions on the charging member in a case where two places of the removing member are brought into contact with the peripheral surface of the charging member at a same time.

6. The image forming device according to claim 5, wherein the removing member is configured to rotate a plurality of times per rotation of the charging member, wherein the detecting unit is configured to detect the current over one or more rotations of the charging member, and wherein the image forming device further comprises an integration unit configured to add up results of detection by the detecting unit for each contact position.

7. A charging device comprising:

a charging roller that is rotatable, wherein the charging roller has a peripheral surface configured to be in contact with a charging target, and wherein the charging roller is configured such that a voltage may be applied to the charging roller for charging the charging target;

a cleaning roller that includes a core and a removing material spirally wound one to less than two times around the core, wherein the cleaning roller is configured to rotate and to come into contact with the charging roller to remove an unnecessary material from the peripheral surface of the charging roller;

a detector configured to detect a current flowing between the charging roller and the cleaning roller; and a controller configured to cause the cleaning roller to execute removal of the unnecessary material if the detector detects by current detection that the charging roller is stained, wherein the controller is configured to, in response to the detector detecting that the charging roller is stained, increase the voltage applied to the charging roller when the cleaning roller removes the unnecessary material.

* * * * *